US007568510B2

(12) United States Patent
Nagaya et al.

(10) Patent No.: US 7,568,510 B2
(45) Date of Patent: Aug. 4, 2009

(54) BOOKBINDING APPARATUS, CONTROL METHOD THEREFOR, IMAGE FORMING APPARATUS, AND CONTROL METHOD THEREFOR

(75) Inventors: Takashi Nagaya, Moriya (JP); Akihito Mori, Toride (JP); Nobuo Sekiguchi, Moriya (JP); Keita Takahashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 742 days.

(21) Appl. No.: 11/188,632

(22) Filed: Jul. 26, 2005

(65) Prior Publication Data

US 2006/0018734 A1 Jan. 26, 2006

(30) Foreign Application Priority Data

Jul. 26, 2004 (JP) ..... 2004-217141
Jul. 25, 2005 (JP) ..... 2005-214901

(51) Int. Cl.
*B42C 9/00* (2006.01)
*B42C 13/00* (2006.01)

(52) U.S. Cl. ..... 156/359; 412/8; 412/11; 412/12; 412/37

(58) Field of Classification Search ..... 156/64, 156/359; 412/8, 11, 12, 37
See application file for complete search history.

(56) References Cited

U.S. PATENT DOCUMENTS 4,473,425 A 9/1984 Baughman et al. ..... 156/356
4,985,729 A 1/1991 Sampath et al. ..... 355/206
5,177,548 A 1/1993 Nakamura et al. ..... 355/324
6,616,135 B1 * 9/2003 Shida et al. ..... 270/58.08
7,448,837 B2 * 11/2008 Oota ..... 412/37

FOREIGN PATENT DOCUMENTS

JP 62-284795 12/1987
JP 7-80377 3/1995

* cited by examiner

*Primary Examiner*—George R Koch, III
(74) *Attorney, Agent, or Firm*—Fitzpatrick, Cella, Harper & Scinto

(57) ABSTRACT

A bookbinding apparatus which is capable of suppressing volatile components of an adhesive causing abnormal odor from leaking out of the bookbinding apparatus, to thereby reduce discomfort to nearby operators and an operator exchanging a deodorizing filter. The bookbinding apparatus 100 is connectable to an image forming apparatus 101 and carries out bookbinding by bonding a plurality of sheets outputted from the image forming apparatus 101 with the adhesive 300. An adhesive heater 302 heats the adhesive 300 and a temperature sensor 301 detects a temperature of the adhesive 300. An adhesive temperature controller 303 controls a heating temperature of the adhesive 300 by the adhesive heater 302, based on the temperature of the adhesive 300 detected by the temperature sensor 301 and a target temperature. When the adhesive temperature controller 303 receives an instruction from the image forming apparatus 101 to set the temperature of the adhesive 300 to a predetermined temperature that is lower than the target temperature, the adhesive temperature controller 303 controls the heating temperature of the adhesive 300 by the heating device 302, so that the temperature of the adhesive 300 becomes lower than a predetermined temperature that is lower than the target temperature.

9 Claims, 12 Drawing Sheets

BOOKBINDING APPARATUS, CONTROL METHOD THEREFOR, IMAGE FORMING APPARATUS, AND CONTROL METHOD THEREFOR

BACKGROUND OF THE INVENTION

1. Field of the Invention

The present invention relates to a bookbinding apparatus which carries out bookbinding by bonding a plurality of sheets, such as paper sheets, outputted from an image forming apparatus, with an adhesive, a control method therefor, an image forming apparatus, and a control method therefor.

2. Description of the Related Art

In recent years, there have been provided bookbinding apparatuses which carry out bookbinding by applying an adhesive to a predetermined position of a plurality of sheets, such as paper sheets, on which images have been recorded by an image forming apparatus, such as a copier, a printer, or a multi-function machine.

Such bookbinding apparatuses include, for example: 1) a bookbinding apparatus that uses an adhesive discharge nozzle to discharge adhesive onto sheets; 2) a bookbinding apparatus that has a rotatable adhesive wheel mounted at an adhesive storage box such that an adhesive is attached to the periphery of the adhesive wheel and the periphery of the adhesive wheel is brought into contact with sheets to thereby bond the sheets together; 3) a bookbinding apparatus that discharges an adhesive formed of a mixture of a hot melt material (thermal adhesive) and hot compressed air through a nozzle; and 4) a bookbinding apparatus that applies a double-sided adhesive tape with an adhesive applied thereon in advance, to one side edge of a bundle of sheets, while heating the adhesive tape.

Moreover, other bookbinding apparatuses are known, including a bookbinding apparatus in which high pressure air is sprayed onto an adhesive that is discharged from an adhesive discharge nozzle to obtain a thin film of adhesive (for example, refer to Japanese Laid-Open Patent Publication (Kokai) No. H07-080377), and a bookbinding apparatus in which sheets are sequentially conveyed in a first direction, are then turned to be conveyed in a second direction perpendicular to the first direction, then a line of adhesive is applied to an edge of the sheets, a plurality of the sheets are stacked and aligned, and pressure is applied to the sheets along the line of adhesive to thereby bind the sheets together (for example, refer to U.S. Pat. No. 4,473,425).

Further, other bookbinding apparatuses are known, including a bookbinding apparatus in which a tape with an adhesive, which becomes sticky when heated, applied thereon in advance is heated and pasted to an edge of a bundle of sheets, and a bookbinding apparatus in which a tape with an adhesive, which becomes sticky when it absorbs water, applied thereon in advance is pasted to an edge of a bundle of sheets (for examples, refer to Japanese Laid-Open Patent Publication (Kokai) No. S62-284795, U.S. Pat. Nos. 5,177,548 and 4,985,729).

Such bookbinding apparatuses have the advantage that, in comparison with bookbinding apparatuses which use staples, they can bind a greater number of sheets into one booklet and thus have high usability.

However, with the bookbinding apparatuses that use adhesive, since the adhesive is heated to a workable temperature, the heating of the adhesive generates an abnormal odor induced from volatile components of the adhesive. Thus, there was a problem that this causes discomfort to nearby operators.

Conventionally, such bookbinding apparatuses that use adhesive are mainly employed in systems, in which the bookbinding apparatuses are connected to large-type image forming apparatuses. Most such systems are placed in an isolated environment set especially for the system, and thus such a problem as stated above does not arise.

However, in recent years, there is increasing demand for systems in which such bookbinding apparatuses that use adhesive are connected to even small to medium size image forming apparatuses set in offices.

To accommodate the above-mentioned demand, measures have been taken such as to provide the bookbinding apparatus with a deodorizing filter to prevent leakage of volatile components of the adhesive to the surroundings.

Generally, there is a time limit to the efficacy of the deodorizing filter. Since the deodorizing ability is degraded by components of the substances that are adsorbed by the deodorizing filter, it is necessary to exchange the deodorizing filter before the deodorizing ability becomes degraded.

When the time to exchange the deodorizing filter is reached and exchange of the deodorizing filter is carried out while the adhesive is in heated state, volatile components of the adhesive which do not pass through the deodorizing filter will leak out of the bookbinding apparatus.

Operators performing the exchange of the deodorizing filter will also be exposed to volatile components of the adhesive.

Further, if bookbinding is carried out without exchanging the deodorizing filter even when the deodorizing filter has reached its exchange time, volatile components of the adhesive will leak out of the bookbinding apparatus.

SUMMARY OF THE INVENTION

It is an object of the present invention to provide a bookbinding apparatus which is capable of suppressing volatile components of the adhesive causing an abnormal odor from leaking out of the bookbinding apparatus, to thereby reduce discomfort to nearby operators and an operator exchanging the deodorizing filter, and a control method therefor, an image forming apparatus, and a control method therefor.

To attain the above-mentioned objects, in a first aspect of the present invention, there is provided a bookbinding apparatus that is connectable to an image forming apparatus and carries out bookbinding by bonding a plurality of sheets outputted from the image forming apparatus with an adhesive, comprising a heating device that heats adhesive, a detecting device that detects a temperature of the adhesive, an adhesive temperature controller that controls a heating temperature of the adhesive by the heating device, based on the temperature of the adhesive detected by the detecting device and a target temperature, and a receiving device that receives an instruction from the image forming apparatus to set the temperature of the adhesive to a predetermined temperature that is lower than the target temperature, wherein the adhesive temperature controller is operable when the receiving device receives the instruction from the image forming apparatus, to control the heating temperature of the adhesive by the heating device so that the temperature of the adhesive becomes lower than the predetermined temperature that is lower than the target temperature.

According to the foregoing construction, it is possible to suppress volatile components of the adhesive causing an abnormal odor from leaking out of the bookbinding apparatus to thereby reduce discomfort to nearby operators and an operator exchanging the deodorizing filter.

Preferably, the bookbinding apparatus comprises a notifying device that is operable when the detecting device detects that the temperature of the adhesive has become lower than the predetermined temperature, to notify the image forming apparatus that the temperature of the adhesive has become lower than the predetermined temperature.

Preferably, the predetermined temperature is set at a value which can prevent volatilization of volatile components of the adhesive.

To attain the above objects, in a second aspect of the present invention, there is provided a bookbinding apparatus that is connectable to an image forming apparatus and carries out bookbinding by bonding a plurality of sheets outputted from the image forming apparatus with an adhesive, comprising a filter that prevents volatile components of the adhesive from leaking out to the surroundings, a heating device that heats the adhesive, a detecting device that detects a temperature of the adhesive, an adhesive temperature controller that controls a heating temperature of the adhesive by the heating device, based on the temperature of the adhesive detected by the detecting device and a target temperature, and a filter exchange time determining device that determines whether or not the filter has reached an exchange time thereof, wherein the adhesive temperature controller is operable when the filter exchange time determining device determines that the filter has reached the exchange time thereof to control the heating temperature of the adhesive by the heating device so that the temperature of the adhesive becomes lower than a predetermined temperature that is lower than the target temperature.

With this configuration, it is possible to provide the same advantageous effects as in the first aspect of the present invention.

Preferably, the filter exchange time determining device comprises a counter that counts a number of times or a number of hours the bookbinding apparatus has been used, and determines that the filter has reached the exchange time thereof when the number of times or the number of hours counted by the counter exceeds a predetermined value.

To attain the above-mentioned objects, in a third aspect of the present invention, there is provided an image forming apparatus having a bonding-type bookbinding function of carrying out bookbinding by bonding a plurality of sheets with an adhesive, comprising a filter that prevents volatile components of the adhesive from leaking out to the surroundings, a heating device that heats the adhesive, a detecting device that detects a temperature of the adhesive, an adhesive temperature controller that controls a heating temperature of the adhesive by the heating device, based on the temperature of the adhesive detected by the detecting device and a target temperature, and a filter exchange time determining device that determines whether or not the filter has reached an exchange time thereof, wherein the adhesive temperature controller is operable when the filter exchange time determining device determines that the filter has reached the exchange time thereof, to control the heating temperature of the adhesive by the heating device so that the temperature of the adhesive becomes lower than a predetermined temperature that is lower than the target temperature.

With this configuration, it is possible to provide the same advantageous effects as in the first aspect of the present invention.

Preferably, the image forming apparatus comprises a displaying device that displays a message to instruct exchange of the filter.

Preferably, the image forming apparatus comprises a bonding-type bookbinding function inhibiting device that inhibits execution of the bonding-type bookbinding function.

Preferably, the filter exchange time determining device comprises a counter that counts a number of times or a number of hours the bonding-type bookbinding function has been used, and a reset device that resets the counter.

Preferably, the image forming apparatus comprises a transmitting device that is operable when the filter exchange time determining device determines that the filter has reached the exchange time thereof, to transmit an instruction to set the temperature of the adhesive to a predetermined temperature that is lower than the target temperature, to the adhesive temperature controller, and wherein the adhesive temperature controller is operable when the transmitting device transmits the instruction to set the temperature of the adhesive to the predetermined temperature that is lower than the target temperature, to the adhesive temperature controller, to control the heating temperature of the adhesive by the heating device based on the instruction so that the temperature of the adhesive becomes lower than the predetermined temperature that is lower than the target temperature.

To attain the above-mentioned objects, in a fourth aspect of the present invention, there is provided a control method for controlling a bookbinding apparatus that is connectable to an image forming apparatus and carries out bookbinding by bonding a plurality of sheets outputted from the image forming apparatus with an adhesive, comprising a heating step of heating the adhesive, a detecting step of detecting a temperature of the adhesive, an adhesive temperature control step of controlling a heating temperature of the adhesive in the heating step, based on the temperature of the adhesive detected in the detecting step and a target temperature, and a receiving step of receiving an instruction from the image forming apparatus to set the temperature of the adhesive to a predetermined temperature that is lower than the target temperature, wherein when the instruction is received from the image forming apparatus in the receiving step, in the adhesive temperature control step, the heating temperature of the adhesive in the heating step is controlled so that the temperature of the adhesive becomes lower than the predetermined temperature that is lower than the target temperature.

To attain the above-mentioned objects, in a fifth aspect of the present invention, there is provided a control method for controlling a bookbinding apparatus that is connectable to an image forming apparatus, and carries out bookbinding by bonding a plurality of sheets outputted from the image forming apparatus with an adhesive, the image forming apparatus including a filter that prevents volatile components of the adhesive from leaking out to the surroundings, the control method comprising a heating step of heating the adhesive, a detecting step of detecting a temperature of the adhesive, an adhesive temperature control step of controlling a heating temperature of the adhesive in the heating step, based on the temperature of the adhesive detected in the detecting step and a target temperature, and a filter exchange time determining step of determining whether or not the filter has reached an exchange time thereof, wherein when it is determined in the filter exchange time determining step that the filter has reached the exchange time thereof, in the adhesive temperature control step, the heating temperature of the adhesive in the heating step is controlled so that the temperature of the adhesive becomes lower than a predetermined temperature that is lower than the target temperature.

To attain the above-mentioned objects, in a sixth aspect of the present invention, there is provided a control method for controlling an image forming apparatus having a bonding-type bookbinding function of carrying out bookbinding by bonding a plurality of sheets with an adhesive, and including a filter that prevents volatile components of the adhesive from leaking out to the surroundings, the control method comprising a heating step of heating the adhesive, a detecting step of detecting a temperature of the adhesive, an adhesive temperature control step of controlling a heating temperature of the adhesive in the heating step, based on the temperature of the adhesive detected in the detecting step and a target temperature, and a filter exchange time determining step of determining whether or not the filter has reached an exchange time thereof, wherein when it is determined in the filter exchange time determining step that the filter has reached the exchange time thereof, in the adhesive temperature control step, the heating temperature of the adhesive in the heating step is controlled so that the temperature of the adhesive becomes lower than a predetermined temperature that is lower than the target temperature.

The above-mentioned and other objects, features, and advantages of the present invention will be apparent from the following description taken in conjunction with the accompanying drawings.

DETAILED DESCRIPTION OF THE PREFERRED EMBODIMENTS

Figure 1:
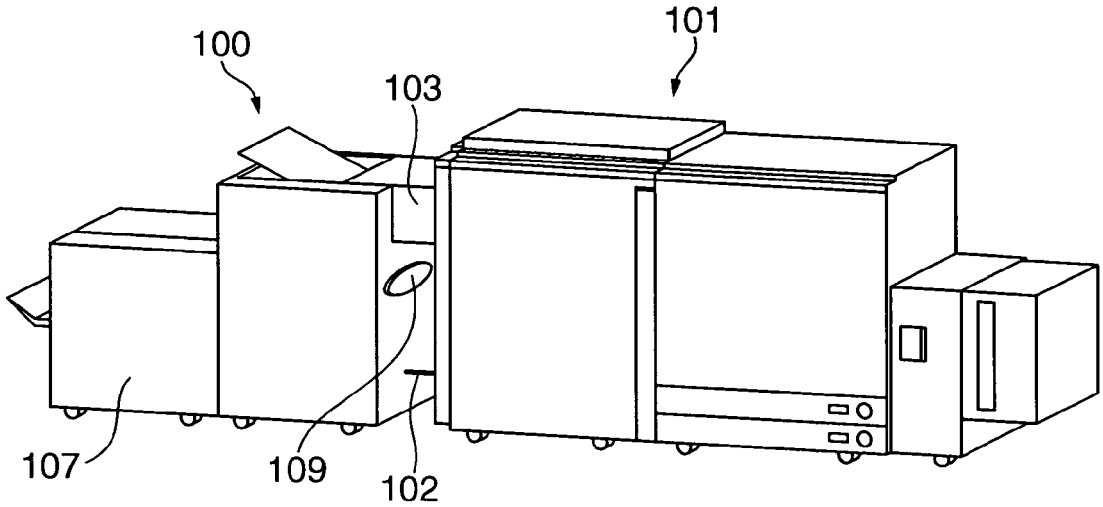
FIG. 1 is a perspective view showing the construction of a bookbinding system including a bookbinding apparatus according to a first embodiment of the present invention.

The present invention will now be described in detail with reference to the drawings showing preferred embodiments thereof. In the drawings, elements and parts which are identical throughout the views are designated by identical reference numerals, and a duplicate description thereof is omitted.

A first embodiment of the present invention will now be described with reference to FIG. 1 to FIG. 10.

Figure 2:
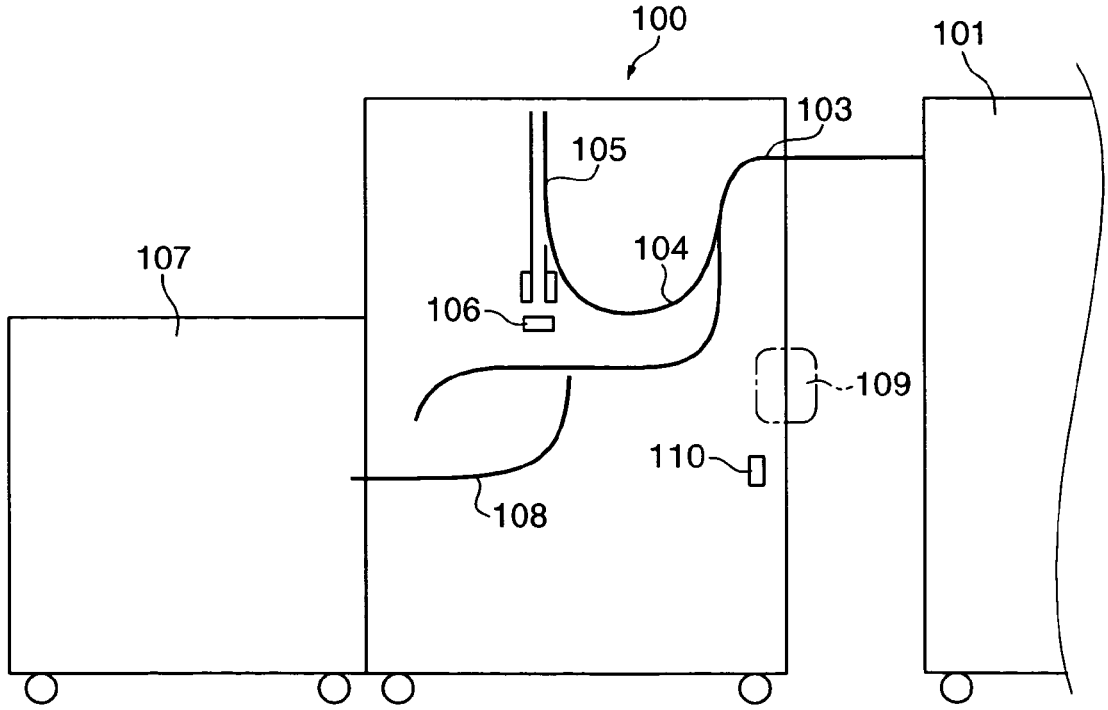
FIG. 2 is a cross-sectional view of the bookbinding apparatus in FIG. 1.

FIG. 1 is a perspective view showing the construction of a bookbinding system including a bookbinding apparatus according to the first embodiment, and FIG. 2 is a cross-sectional view of the bookbinding apparatus in FIG. 1.

As shown in FIG. 1, the bookbinding system is comprised of the bookbinding apparatus 100 according to the present embodiment, and an image forming apparatus 101, which are connected together.

The bookbinding apparatus 100 is connected to the image forming apparatus 101 via a signal line 102. The bookbinding apparatus 100 has a bookbinding function in which bookbinding is carried out by aligning a plurality of sheets, such as paper sheets, outputted from the image forming apparatus 101 and bonding the sheets with an adhesive.

As shown in FIG. 2, the bookbinding apparatus 100 is comprised of a sheet intake opening 103, and a sheet intake conveyance path 104 through which sheets outputted from the image forming apparatus 101 are conveyed sheet by sheet, a sheet aligning section 105 that stacks the conveyed plurality of sheets and aligns the stacked plurality of sheets, an adhesive applying member 106 that bonds the stacked plurality of sheets (hereinafter referred to as the "sheet bundle") in the sheet aligning section 105, a sheet bundle stacking section 107, and a sheet bundle discharge conveyance path 108 that conveys the bonded sheet bundle to the sheet bundle stacking section 107.

The bookbinding apparatus 100 is provided with a deodorizing filter 109 and an attachment/detachment sensor 110 that detects attachment and detachment of the deodorizing filter 109. The deodorizing filter 109 is provided to prevent components of the adhesive, which are volatilized when the adhesive is heated to a workable temperature, from leaking out of the bookbinding apparatus 100. The deodorizing filter 109 is detachably attached to the bookbinding apparatus 100 so that it can be exchanged by the user or an operator, or a service man.

Generally, there is a time limit to the efficacy of the deodorizing filter 109. Since the deodorizing ability becomes degraded by components of the substances that attach to the deodorizing filter 109, it is necessary to exchange the deodorizing filter 109 before the deodorizing ability becomes degraded. Whether to exchange the deodorizing filter 109 or not is determined from the number of hours or the number of times the bookbinding function of the bookbinding apparatus 100 has been used.

The image forming apparatus 101 has an image forming function of forming a copy image or a printout image on sheets that are fed sheet by sheet, by the electrophotographic method. The image forming apparatus 101 and the bookbinding apparatus 100 are arranged side by side so that the image forming apparatus 101 feeds sheets on which images have been formed to the bookbinding apparatus 100.

Next, a description will be given of the outline of the bookbinding operation of the bookbinding apparatus 100.

Sheets outputted from the image forming apparatus 101 are conveyed in sequence to the sheet aligning section 105, via the sheet intake opening 103 and the sheet intake conveyance path 104, and are stacked as a sheet bundle. After the sheet bundle is stacked in the sheet aligning section 105, an adhesive is applied to a side edge surface of the sheet bundle by the adhesive applying member 106 to thereby bond the sheet bundle together. Then, the bonded sheet bundle is conveyed to the sheet bundle stacking section 107 via the sheet bundle discharge conveyance path 108.

Next, a description will be given of the temperature control of the adhesive.

The adhesive that is applied to the side edge surface of the sheet bundle as described above is in a solid phase at room temperature. At the time of actual bonding, the adhesive must be heated to a workable temperature (in this case, approximately 180° C.) into a liquid state in order to exhibit an adhesive effect. Thus, to stably keep the adhesive at a predetermined temperature, a temperature controller, a temperature sensor, and an adhesive heater are provided in the bookbinding apparatus 100.

Figure 3:
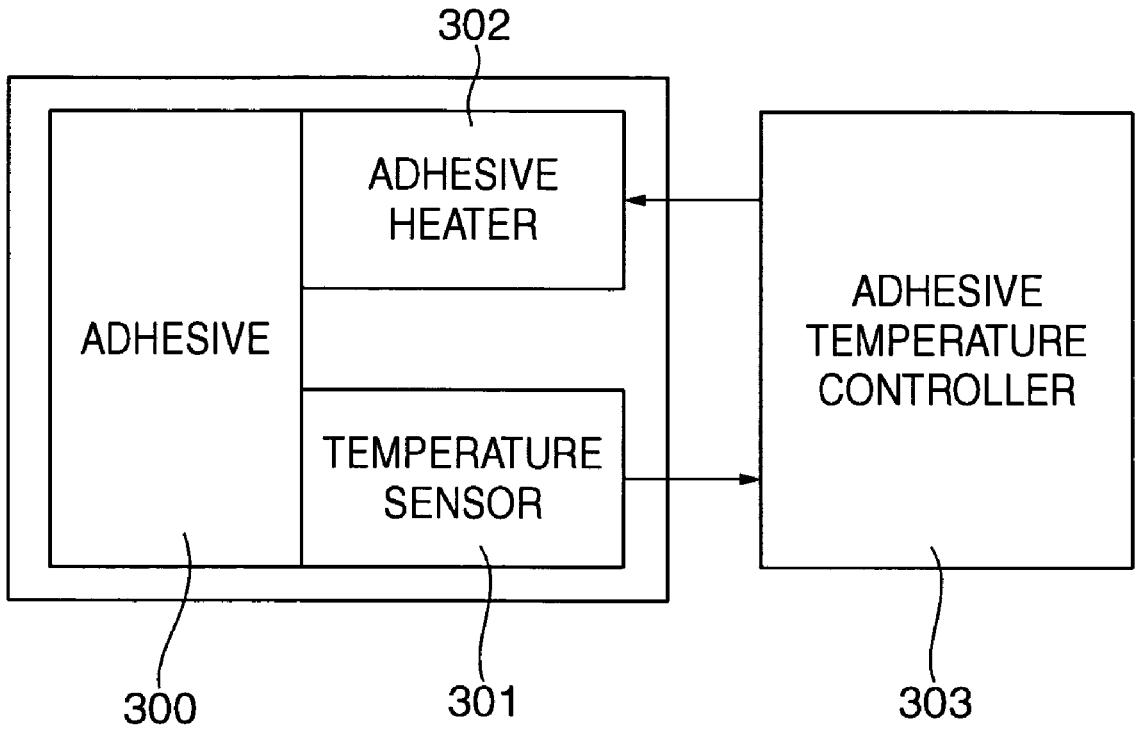
FIG. 3 is a block diagram showing the construction of parts of the bookbinding apparatus related to adhesive temperature control.

FIG. 3 is a block diagram showing the construction of parts of the bookbinding apparatus 100 related to the adhesive temperature control. In FIG. 3, reference numeral 300 designates an adhesive that is applied to the side edge surface of the sheet bundle, reference numeral 301 designates the temperature sensor that detects the temperature of the adhesive 300, reference numeral 302 designates the adhesive heater that heats the adhesive 300, and reference numeral 303 designates the adhesive temperature controller that controls the temperature of the adhesive 300.

The adhesive temperature controller 303 is electrically connected to the temperature sensor 301 and the adhesive heater 302.

Figure 4A:
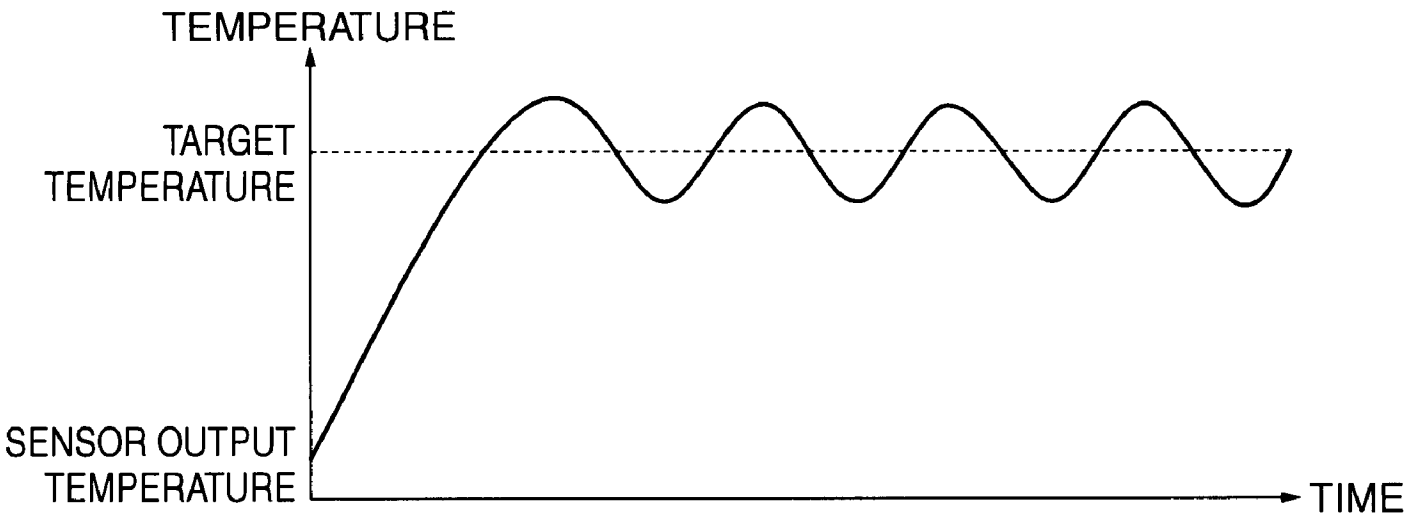
FIG. 4A is a diagram showing the relationship between the temperature of an adhesive and time.
Figure 4B:
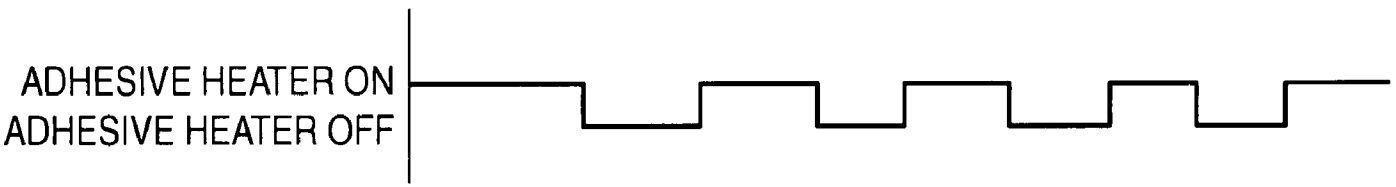
FIG. 4B is a diagram showing the timing of turning on/off a heater for the adhesive.

FIGS. 4A and 4B are diagrams showing how temperature control of the adhesive 300 is carried out using the temperature sensor 301 and the adhesive heater 302. FIG. 4A is a diagram showing the relationship between the temperature of the adhesive 300 and time, and FIG. 4B is a diagram showing the timing of turning on/off the adhesive heater 302.

Figure 5:
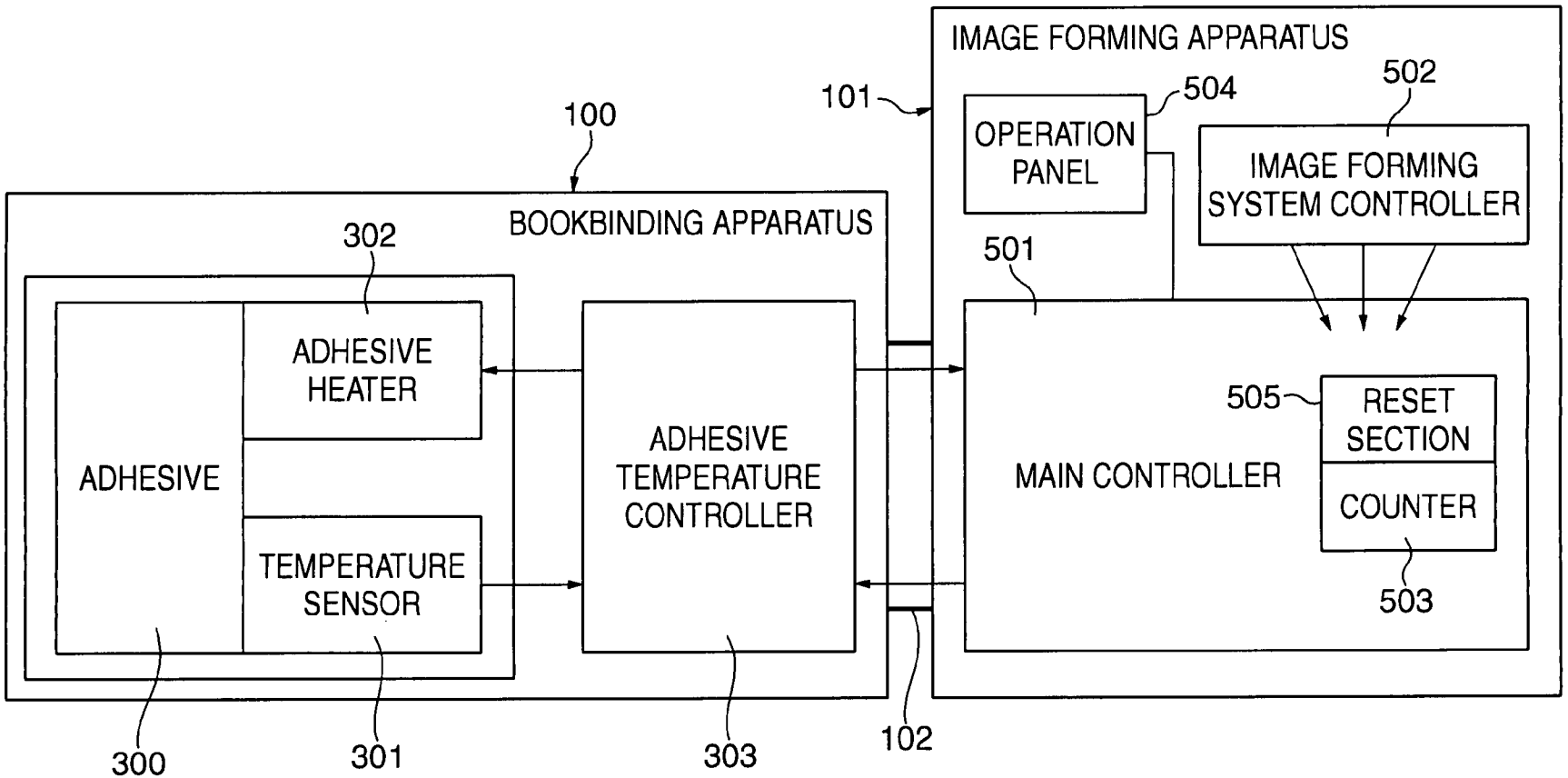
FIG. 5 is a schematic diagram useful in explaining a method of instructing temperature control of the adhesive between the bookbinding apparatus and an image forming apparatus.

FIG. 5 is a schematic diagram useful in explaining a method of instructing temperature control of the adhesive between the bookbinding apparatus 100 and the image forming apparatus 101. In FIG. 5, the same elements and parts as those appearing in FIGS. 1 to 3 are designated by the same reference numerals.

The adhesive temperature controller 303 is supplied with a detected temperature signal from the temperature sensor 301 and outputs a control signal to the adhesive heater 302. The adhesive temperature controller 303 periodically checks the temperature value of the detected temperature signal inputted from the temperature sensor 301, and compares the same with a target temperature value. If the temperature value of the detected temperature signal inputted from the temperature sensor 301 is below the target temperature value, the adhesive temperature controller 303 turns on the adhesive heater 302, and if the temperature value of the input detected temperature signal is above the target temperature value, the adhesive temperature controller 303 turns off the adhesive heater 302. By carrying out temperature control in this manner, the temperature value of the adhesive 300 is controlled to and maintained at the target temperature value.

The adhesive temperature controller 303 is connected to the image forming apparatus 101 via the signal line 102 as a communication means. A first instruction from the image forming apparatus 101 via the signal line 102 triggers the adhesive temperature controller 303 to start temperature control such that the temperature value of the adhesive 300 becomes equal to a first target temperature. Here, the first target temperature is set to a predetermined workable temperature (in this case, 180° C.).

Further, a second instruction from the image forming apparatus 101 triggers the adhesive temperature controller 303 to start temperature control such that the temperature value of the adhesive 300 becomes equal to a second target temperature. Here, the second target temperature is set to a predetermined temperature that is lower than the first target temperature and is not likely to cause components of the adhesive 300 to be volatilized (in this case, 30° C.).

Referring to FIG. 5, the image forming apparatus 101 is comprised of a main controller 501, and an image forming system controller 502. The main controller 501 is connected to the image forming system controller 502 that controls the whole system, and can make various determinations using various information on the image forming apparatus 101 and various information on copy jobs or printout jobs which are a group of data formed of a sequence of image data and post-processing method data inputted to the image forming apparatus 101.

The main controller 501 has provided therein a counter 503 and a reset section 505 that resets the counter 503, and determines whether a copy job or a printout job to be carried out is a bookbinding job that performs bookbinding using the adhesive 300. The counter 503 counts and stores the number of times bookbinding jobs have been carried out as a counter value. By comparing the counter value with a predetermined threshold value (in the present embodiment, 3000 booklets), the main controller 501 can determine whether the deodorizing filter 109 has reached its exchange time.

When the deodorizing filter 109 has reached its exchange time, the main controller 501 transmits a second instruction to the adhesive temperature controller 303 of the bookbinding apparatus 100 via the signal line 102. At the same time, the main controller 501 inhibits use of the bonding-type bookbinding function of the bookbinding apparatus 100 by displaying an appropriate message on an operation panel 504 that is connected to the main controller 501, and imposes partial limitations upon the operation of the whole image forming system.

Figure 6:
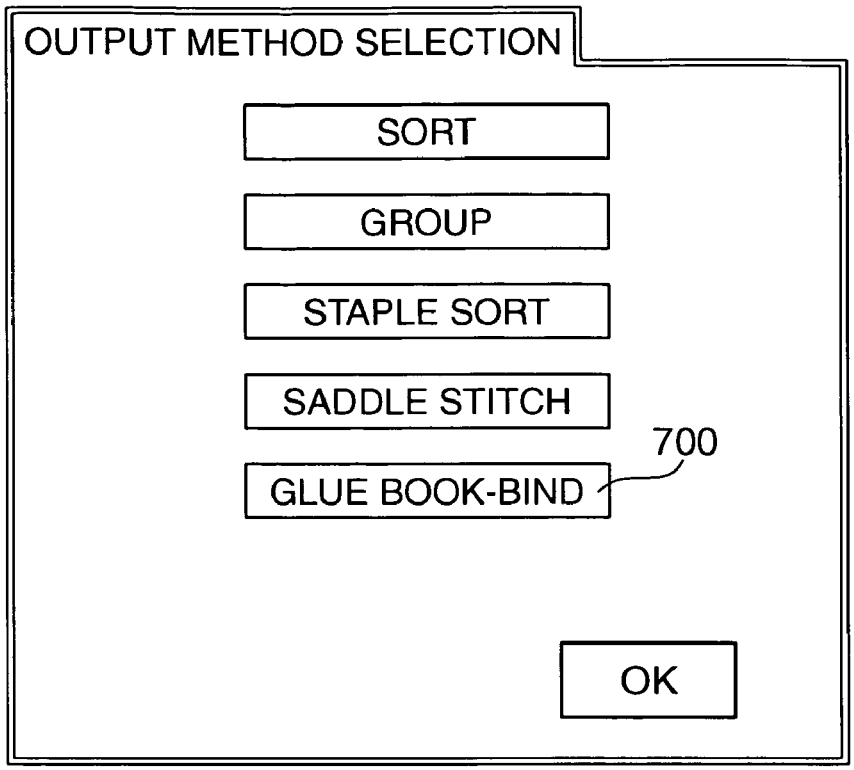
FIG. 6 is a view showing an example of a display of an operation panel for selecting an output method when a deodorizing filter is in a normal state.
Figure 7:
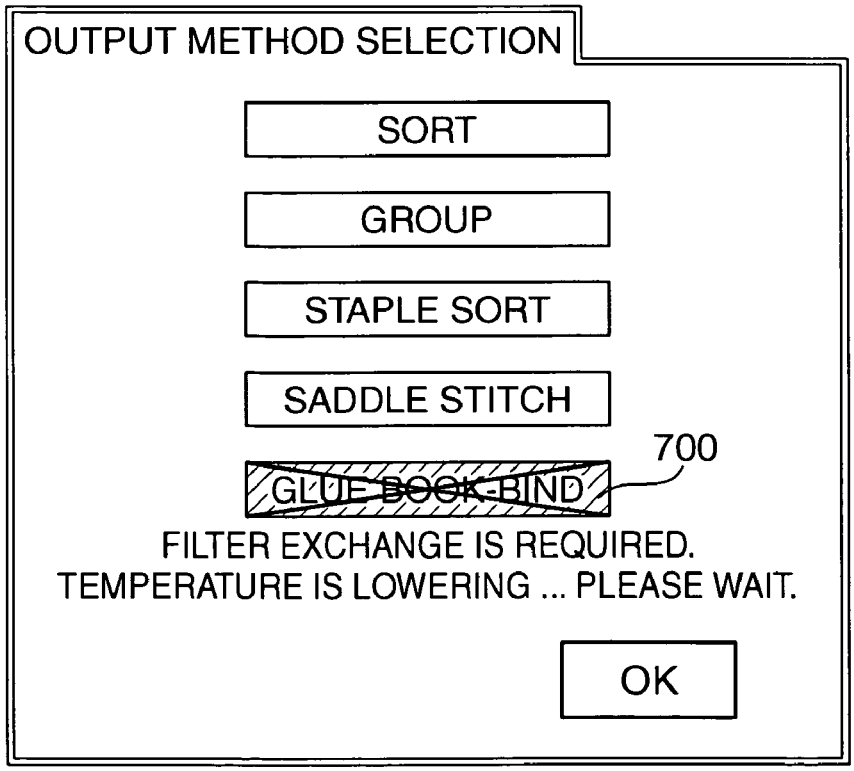
FIG. 7 is a view showing an example of a display of the operation panel for selecting an output method when the deodorizing filter has reached its exchange time.

FIG. 6 is a view showing an example of a display of the operation panel 504 for selecting an output tray when the deodorizing filter 109 is in a normal state, and FIG. 7 is a view showing an example of a display of the operation panel 504 for selecting an output tray when the deodorizing filter 109 has reached its exchange time.

In FIGS. 6 and 7, reference numeral 700 designates a bonding-type (gluing-type) bookbinding button. In FIG. 7, the bonding-type (gluing-type) bookbinding button 700 is crossed out and hatched to indicate to the user that the bonding-type (gluing-type) bookbinding function of the bookbinding apparatus 100 cannot be selected as an output method.

In this manner, when the number of times bookbinding jobs have been performed exceeds the predetermined threshold value, the main controller 501 changes the heating temperature of the adhesive heater 302 to the second target temperature (30° C.), and partially inhibits the operation of the bookbinding apparatus 100.

Upon receiving the second instruction, the adhesive temperature controller 303 changes the target temperature of the adhesive heater 302 to the second target temperature (30° C.) and monitors the adhesive heater 302 until the output value from the temperature sensor 301 becomes lower than a predetermined temperature (50° C. in the present embodiment). When the output value from the temperature sensor 301 becomes lower than 50° C., the adhesive temperature controller 303 transmits a first response signal to the main controller 501 of the image forming apparatus 101 via the signal line 102.

Upon receiving the first response signal, the main controller 501 displays a message on the operation panel 504 prompting the user to exchange the deodorizing filter 109.

Figure 8:
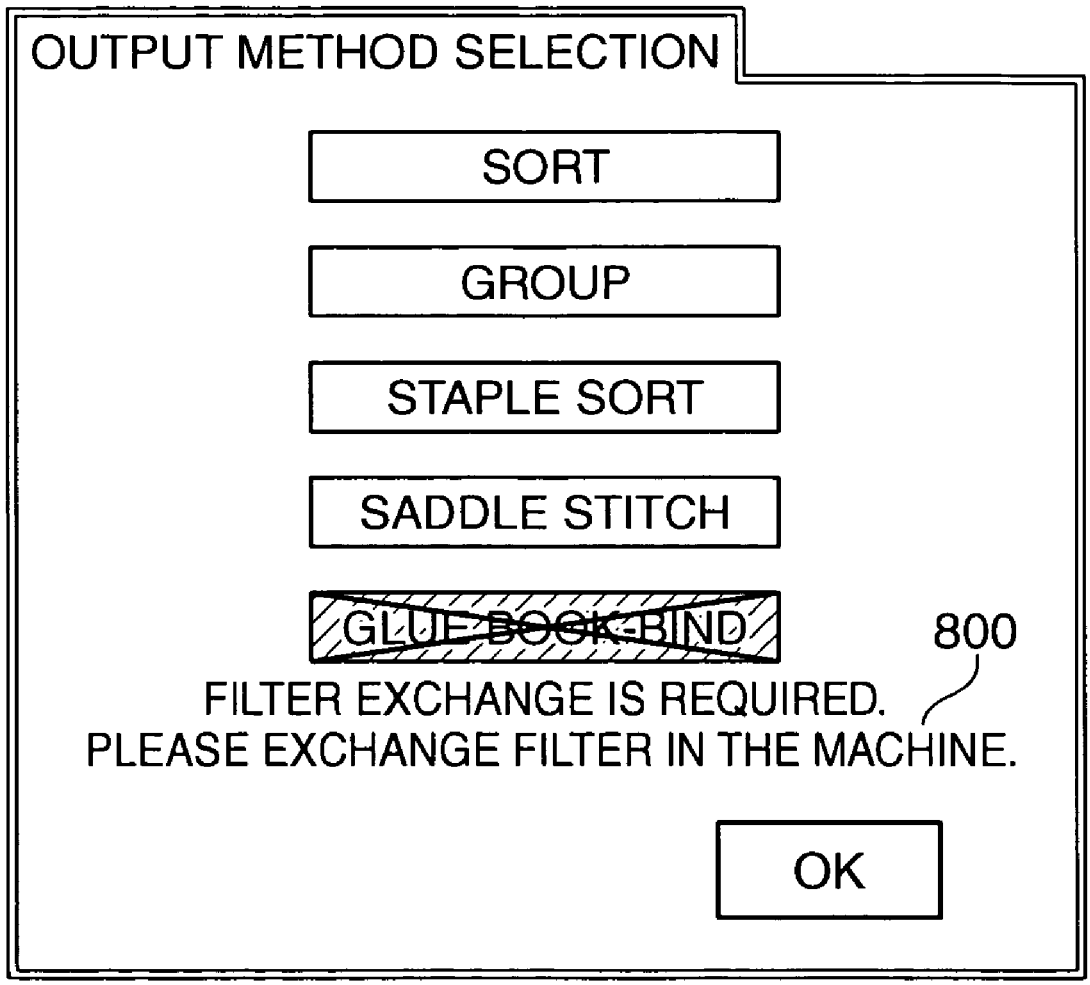
FIG. 8 is a view showing an example of a display of the operation panel for selecting an output tray, in which a message instructing exchange of the deodorizing filter is displayed.

FIG. 8 is a view showing an example of a display of the operation panel 504 for selecting an output tray, in which a message instructing exchange of the deodorizing filter 109 is displayed. In FIG. 8, reference numeral 800 designates the message that is displayed to prompt the user to exchange the deodorizing filter 109.

Next, a description will be given of the control operation of the main controller 501 relating to control of the bookbinding apparatus 100 with reference to FIG. 9.

Figure 9:
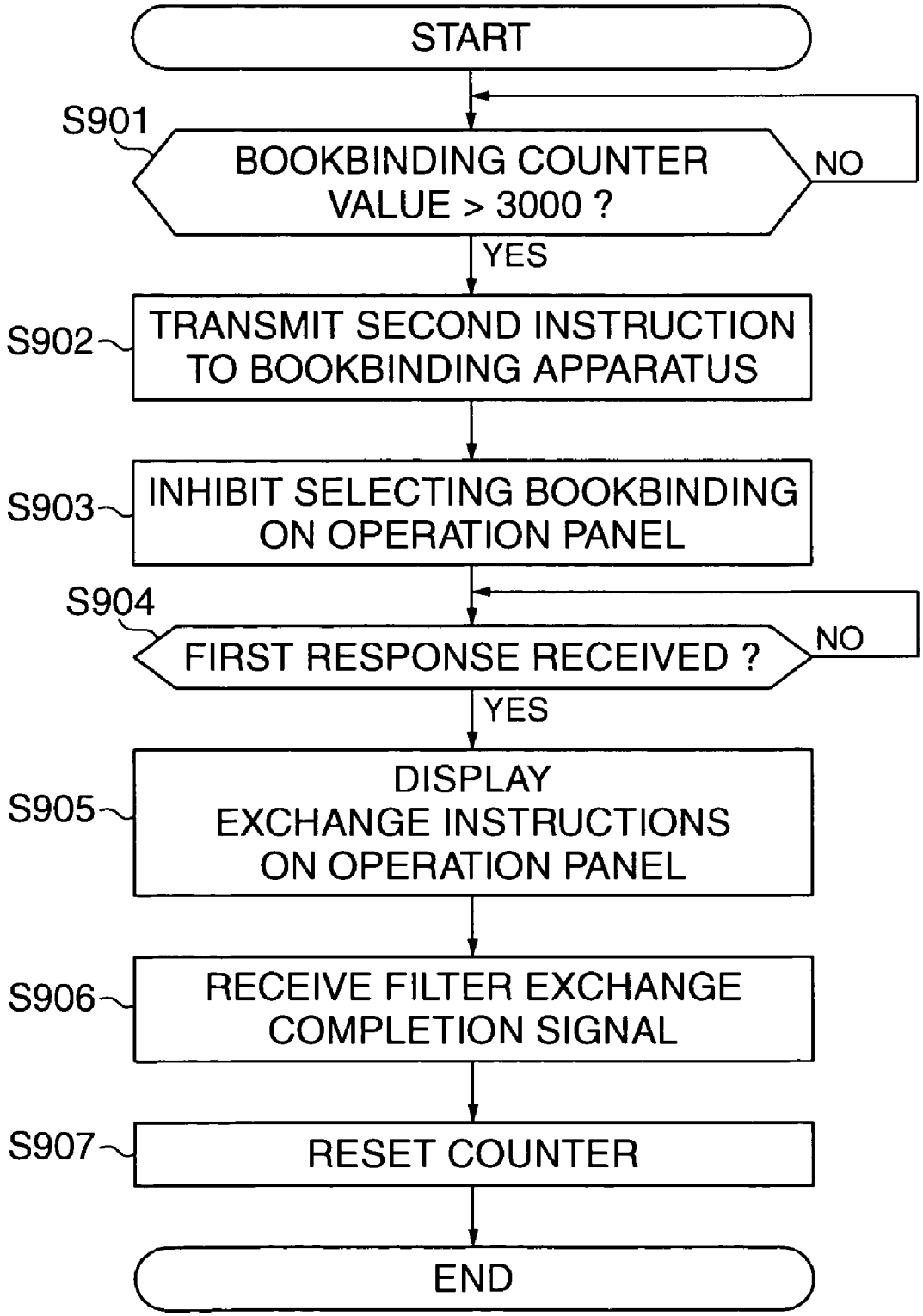
FIG. 9 is a flowchart showing the control operation of a control section of the image forming apparatus.

FIG. 9 is a flowchart showing the control operation of the main controller 501.

First, in a step S901, it is determined whether the counter value of the counter 503 has exceeded the predetermined threshold value, i.e. 3000. If the answer is affirmative (YES), it is determined that the filter has reached its exchange time, and the process proceeds to a step S902. If the answer is negative (NO), the determination of the step S901 is repeated until it is determined that the counter value of the counter 503 has exceeded 3000.

In the step S902, the second instruction for lowering the heating temperature is transmitted via the signal line 102 to the bookbinding apparatus 100, and then the process proceeds to a step S903.

In the step S903, an appropriate message indicating that the use of the bookbinding apparatus 100 is inhibited is displayed on the operation panel 504 (refer to FIG. 7), and the process proceeds to a step S904.

In the step S904, it is determined whether or not the first response signal that indicates that the output value from the temperature sensor 301 has become lower than the predetermined temperature has been received from the bookbinding apparatus 100 via the signal line 102. If it is determined that the first response signal has been received, the process proceeds to a step S905. If not, the determination of the step S904 is repeated until the first response signal is received.

In the step S905, a message is displayed on the operation panel 504 to prompt the user to exchange the deodorizing filter 109 (refer to FIG. 8). Then, in a step S906, the reset section 505 receives a signal from the attachment/detachment sensor 110, that is, a signal indicating that the filter exchange has been completed. In the following step S907, the main controller 501 recognizes from the reception of this signal that the deodorizing filter 109 has been exchanged, and resets the counter 503. The main controller 501 cancels the inhibition of the use of the bonding-type bookbinding function of the bookbinding apparatus 100 to make it possible to select the bonding-type (gluing-type) bookbinding button 700 on the operation panel 504. Then, the process is terminated.

Next, a description will be given of the control operation of the adhesive temperature controller 303 of the bookbinding apparatus 100 with reference to FIG. 10.

Figure 10:
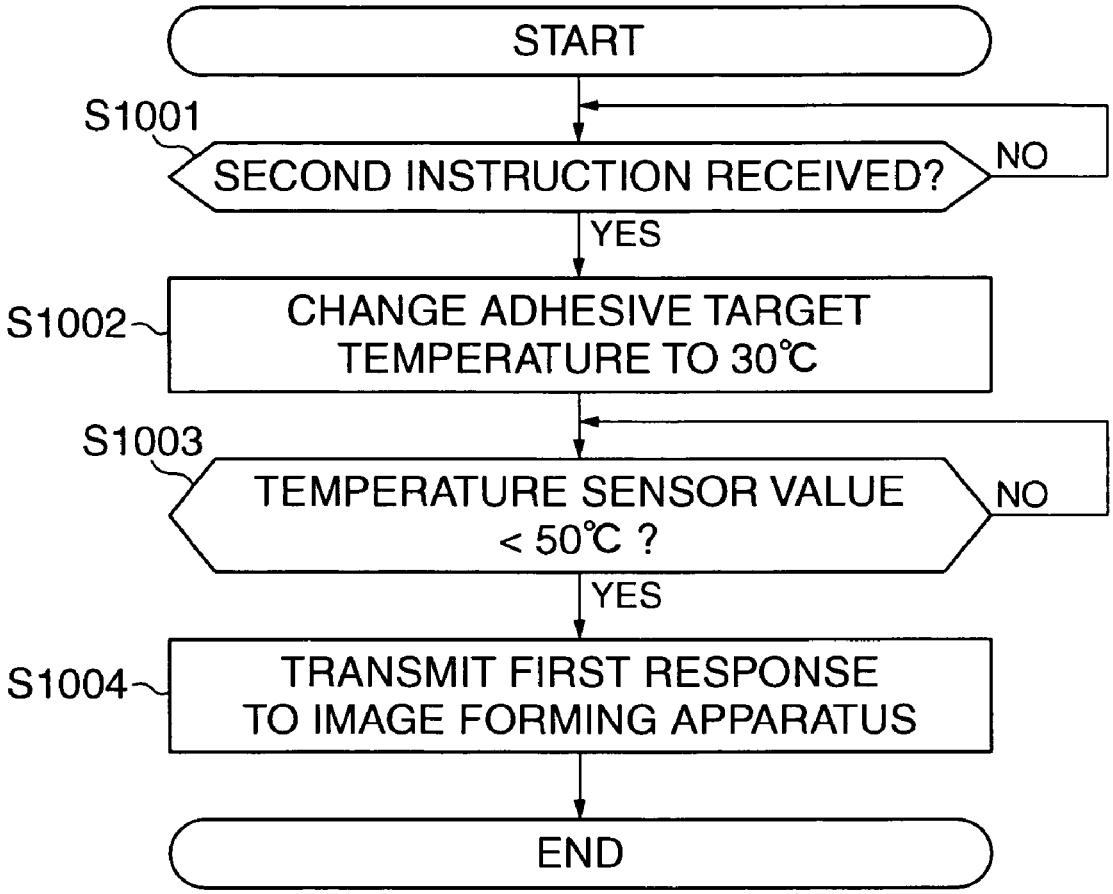
FIG. 10 is a flowchart showing the control operation of an adhesive temperature controller of the bookbinding apparatus.

FIG. 10 is a flowchart showing the control operation of the adhesive temperature controller 303 of the bookbinding apparatus 100.

First, in a step S1001, it is determined whether or not the second instruction for lowering the heating temperature of the adhesive heater 302 has been received from the image forming apparatus 101 via the signal line 102. If it is determined that the second instruction has been received, the process proceeds to a step S1002. If not, the determination of the step S1001 is repeated until the second instruction is received.

In the step S1002, the target temperature of the adhesive heater 302 is changed to 30° C., and the process proceeds to a step S1003.

In the step S1003, it is determined whether the output value from the temperature sensor 301 is below 50° C. If the answer is affirmative (YES), the process proceeds to a step S1004. If the answer is negative (NO), the process of the step S1003 is repeated until the answer is affirmative.

In the step S1004, the first response signal that indicates that the output value from the temperature sensor 301 has become lower than 50° C. is transmitted to the image forming apparatus 101 via the signal line 102. Then, the main control operation is terminated. When the deodorizing filter 109 is exchanged after the first response signal is transmitted, the attachment/detachment sensor 110 transmits a signal indicating that the deodorizing filter 109 has been exchanged, to the main controller 501.

With the above-described construction and control, when the deodorizing filter 109 reaches its exchange time, the temperature of the adhesive 300 is automatically lowered. Then, when the temperature of the adhesive 300 becomes lower than a predetermined temperature, an instruction to exchange the deodorizing filter 109 is displayed on the operation panel 504.

Further, when the deodorizing filter 109 reaches its exchange time, the bonding-type (gluing-type) bookbinding function can be automatically inhibited.

As described above, according to the present embodiment it is possible to automatically lower the temperature of the adhesive 300 when the deodorizing filter 109 reaches its exchange time, and display an instruction to exchange the deodorizing filter 109 on the operation panel 504 after the temperature of the adhesive 300 becomes lower than a predetermined temperature. As a result, when exchanging the deodorizing filter 109, it is possible to prevent volatilization of volatile components of the adhesive 300 and leakage of volatile components from the bookbinding apparatus 100, thus reducing discomfort to an operator exchanging the deodorizing filter 109 and nearby operators.

Further, when the deodorizing filter 109 reaches its exchange time, by automatically inhibiting use of the bonding-type (gluing-type) bookbinding function, it is possible to prevent leakage of volatile components from the bookbinding apparatus 100 that is caused by functional degradation of the deodorizing filter 109.

A second embodiment of the present invention will now be described with reference to FIG. 11 to FIG. 13.

It should be noted that the bookbinding apparatus and the bookbinding system including the bookbinding apparatus according to the second embodiment are identical in construction to those of the first embodiment shown in FIGS. 1 and 2, and thus these figures will also be referred to describe the second embodiment.

In the second embodiment, a counter 1101 that measures the energization time period of the adhesive heater 302, and a reset section 1102 that resets the counter 1101 are provided inside the adhesive temperature controller 303 of the bookbinding apparatus 100.

A detailed description will now be provided of these components.

Figure 11:
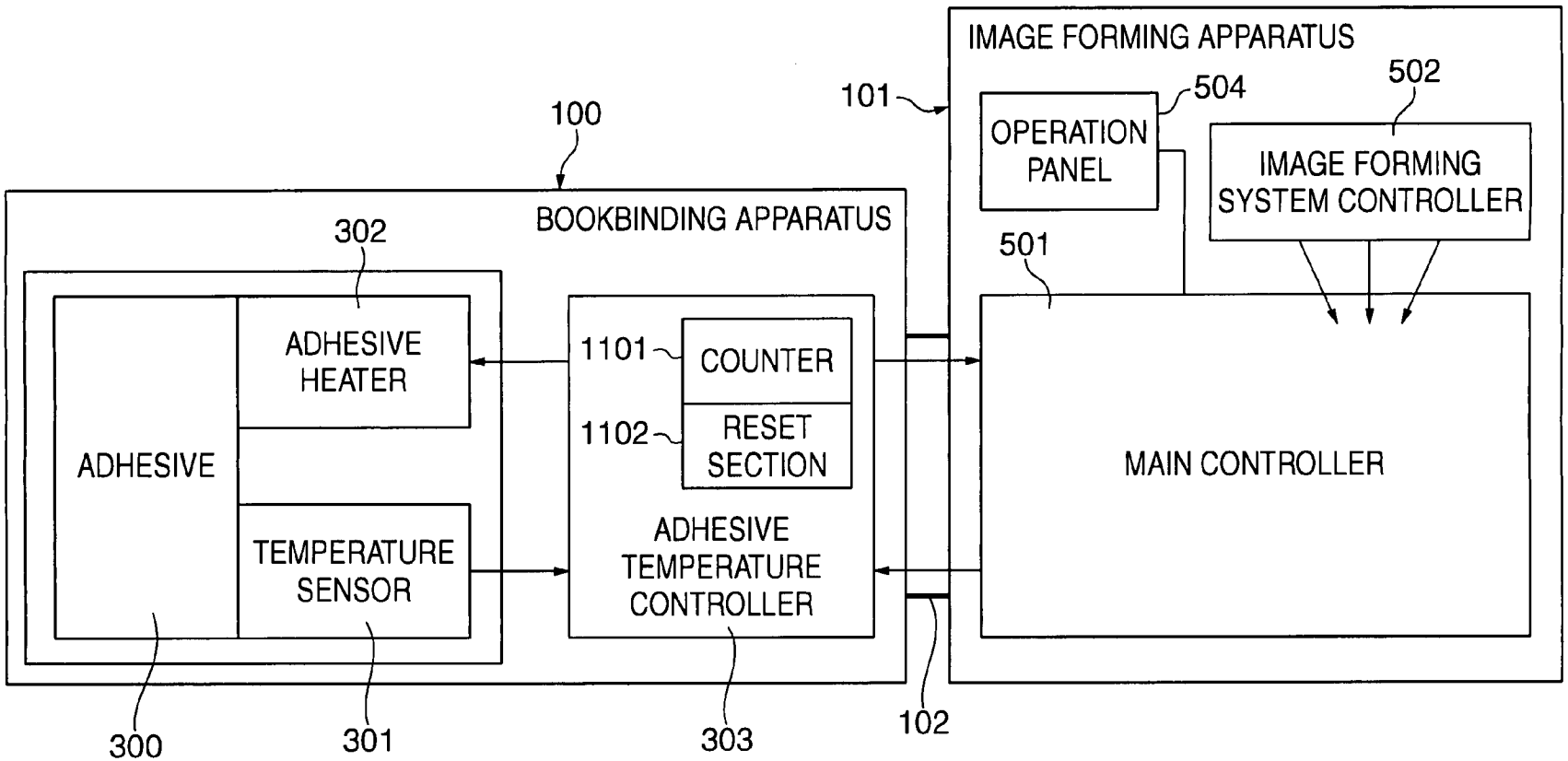
FIG. 11 is a schematic diagram useful in explaining a method of instructing temperature control of the adhesive between a bookbinding apparatus and an image forming apparatus according to a second embodiment of the present invention.

FIG. 11 is a schematic diagram useful in explaining a method of instructing temperature control of the adhesive between the bookbinding apparatus 100 and the image forming apparatus 101 according to the second embodiment. In FIG. 11, the same reference numerals designate the same sections indicated in FIG. 5.

In the present embodiment, the adhesive temperature controller 303 causes the counter 1101 to measure the energization time period of the adhesive heater 302 and stores the cumulative value of the measured energization time period as a counter value. The adhesive temperature controller 303 compares the counter value with a predetermined threshold value (in the present embodiment, 1000 hours) to thereby determine whether the deodorizing filter 109 has reached its exchange time.

If it is determined that the deodorizing filter 109 has reached its exchange time, the adhesive temperature controller 303 transmits a second response signal indicating that the deodorizing filter 109 has reached its exchange time, to the main controller 501 via the signal line 102, and at the same time, changes the target temperature of the adhesive heater 302 to 30° C.

Here, the main controller 501 that receives the second response signal inhibits use of the bonding-type (gluing-type) bookbinding function of the bookbinding apparatus 100 by displaying an appropriate message on the operation panel 504, and partially limits the operation of the whole image forming system.

In the present embodiment, the display of the operation panel 504 for selecting an output tray when the deodorizing filter 109 is in a normal state is the same as that of FIG. 6, and the display of the operation panel 504 when the deodorizing filter 109 has reached its exchange time is the same as that of FIG. 7.

The adhesive temperature controller 303 monitors the adhesive heater 302 until the output value from the temperature sensor 301 becomes lower than a predetermined temperature (50° C. in the present embodiment). When the output value from the temperature sensor 301 becomes lower than 50° C., the adhesive temperature controller 303 transmits a first response signal to the main controller 501 of the image forming apparatus 101, via the signal line 102, to indicate that the output value from the temperature sensor 301 has become lower than 50° C.

Upon receiving the first response signal, the main controller 501 displays a message prompting the user to exchange the deodorizing filter 109, on the operation panel 504.

In the present embodiment, the display of the operation panel 504 instructing exchange of the deodorizing filter 109 is the same as that of FIG. 8.

Next, a description will be given of the control operation of the main controller 501 of the image forming apparatus 101 according to the second embodiment with reference to FIG. 12.

Figure 12:
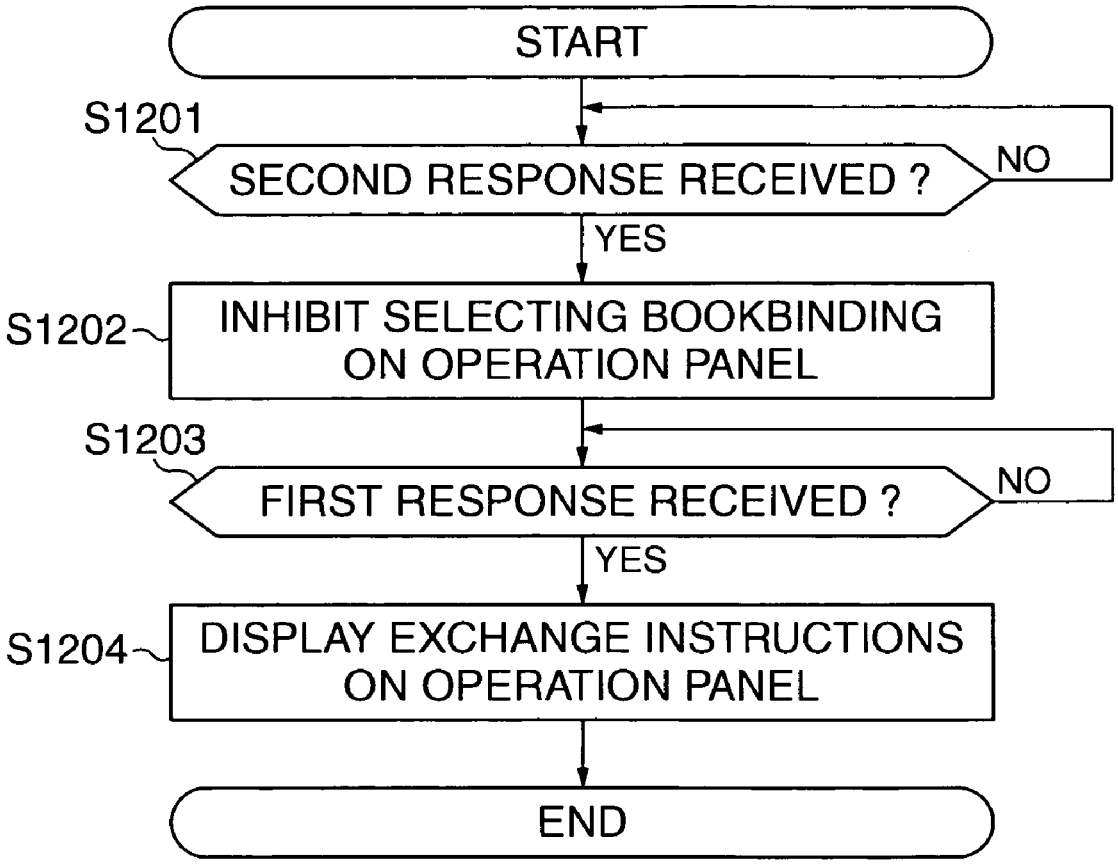
FIG. 12 is a flowchart showing the control operation of the control section of the image forming apparatus.

FIG. 12 is a flowchart showing the control operation of the main controller 501.

First, in a step S1201, it is determined whether the second response signal that indicates that the deodorizing filter 109 has reached its exchange time has been received from the bookbinding apparatus 100 via the signal line 102. If it is determined that the second response signal has been received, the process proceeds to a step S1202. If not, the determination of the step S1201 is repeated until the second response signal is received.

In the step S1202, an appropriate message indicating that the use of the bookbinding apparatus 100 is inhibited is displayed on the operation panel 504 (refer to FIG. 7), and the process proceeds to a step S1203.

In the step S1203, it is determined whether or not the first response signal that indicates that the output value from the temperature sensor 301 has become lower than 50° C. has been received from the bookbinding apparatus 100 via the signal line 102. If it is determined that the first response signal has been received, the process proceed to a step S1204. If not, the determination of the step S1203 is repeated until the first response signal is received.

In the step S1204, a message is displayed on the operation panel 504 to prompt the user to exchange the deodorizing filter 109. Then, after a signal is received from the attachment/detachment sensor 110 indicating that the deodorizing filter 109 has been exchanged, the inhibition of the use of the bonding-type bookbinding function of the bookbinding apparatus 100 is cancelled so that the bonding-type (gluing-type) bookbinding button 700 can be selected on the operation panel 504. Then, the process is terminated.

Figure 13:
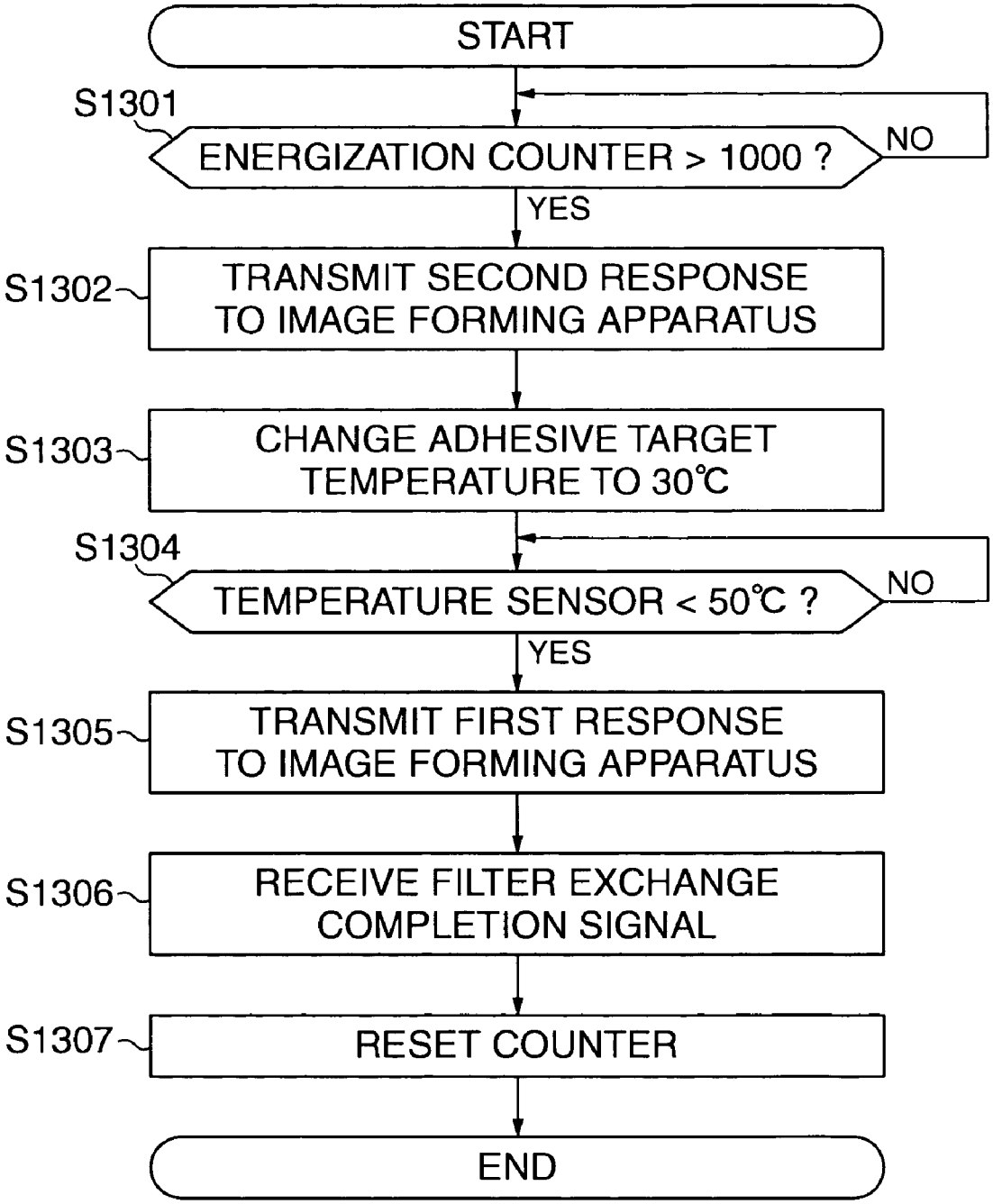
FIG. 13 is a flowchart showing the control operation of the adhesive temperature controller of the bookbinding apparatus.

Next, a description will be provided of the control operation of the adhesive temperature controller 303 of the bookbinding apparatus 100 with reference to FIG. 13.

FIG. 13 is a flowchart showing the control operation of the control section of the adhesive temperature controller 303 of the bookbinding apparatus 100.

First, in a step S1301, it is determined whether or not the counter value of the counter 1101 has exceeded 1000 hours. If the answer is affirmative (YES), it is determined that the deodorizing filter 109 has reached its exchange time, and the process proceeds to a step S1302. If the answer is negative (NO), the process of the step S1301 is repeated until the answer is affirmative.

In the step S1302, the second response signal that indicates that the deodorizing filter 109 has reached its exchange time is transmitted to the image forming apparatus 101 via the signal line 102. Then, the process proceeds to the following step S1303.

In the step S1303, the target temperature of the adhesive heater 302 is changed to 30° C., and the process proceeds to a step S1304.

In the step S1304, it is determined whether the output value from the temperature sensor 301 is below 50° C. If the answer is affirmative (YES), the process proceeds to a step S1305, and if the answer is negative (NO), the process of the step S1304 is repeated until the answer is affirmative.

In the step S1305, the first response signal is transmitted to the image forming apparatus 101 via the signal line 102, indicating that the output value from the temperature sensor 301 has become lower than 50° C. In the following step S1306, when the deodorizing filter 109 is exchanged after the first response signal is transmitted, the reset section 1102 receives a signal from the attachment/detachment senor 110 indicating that the deodorizing filter 109 has been exchanged. Then, in a step S1307, the counter 1101 is reset and the process is terminated.

With the above-described construction and method of control, as in the first embodiment, when the deodorizing filter 109 reaches its exchange time, the temperature of the adhesive 300 is automatically lowered. Then, when the temperature of the adhesive 300 becomes lower than a predetermined temperature, it is possible to display an instruction to exchange the deodorizing filter 109 on the operation panel 504.

Further, when the deodorizing filter 109 reaches its exchange time, the bonding-type (gluing-type) bookbinding function can be automatically inhibited.

Figure 14:
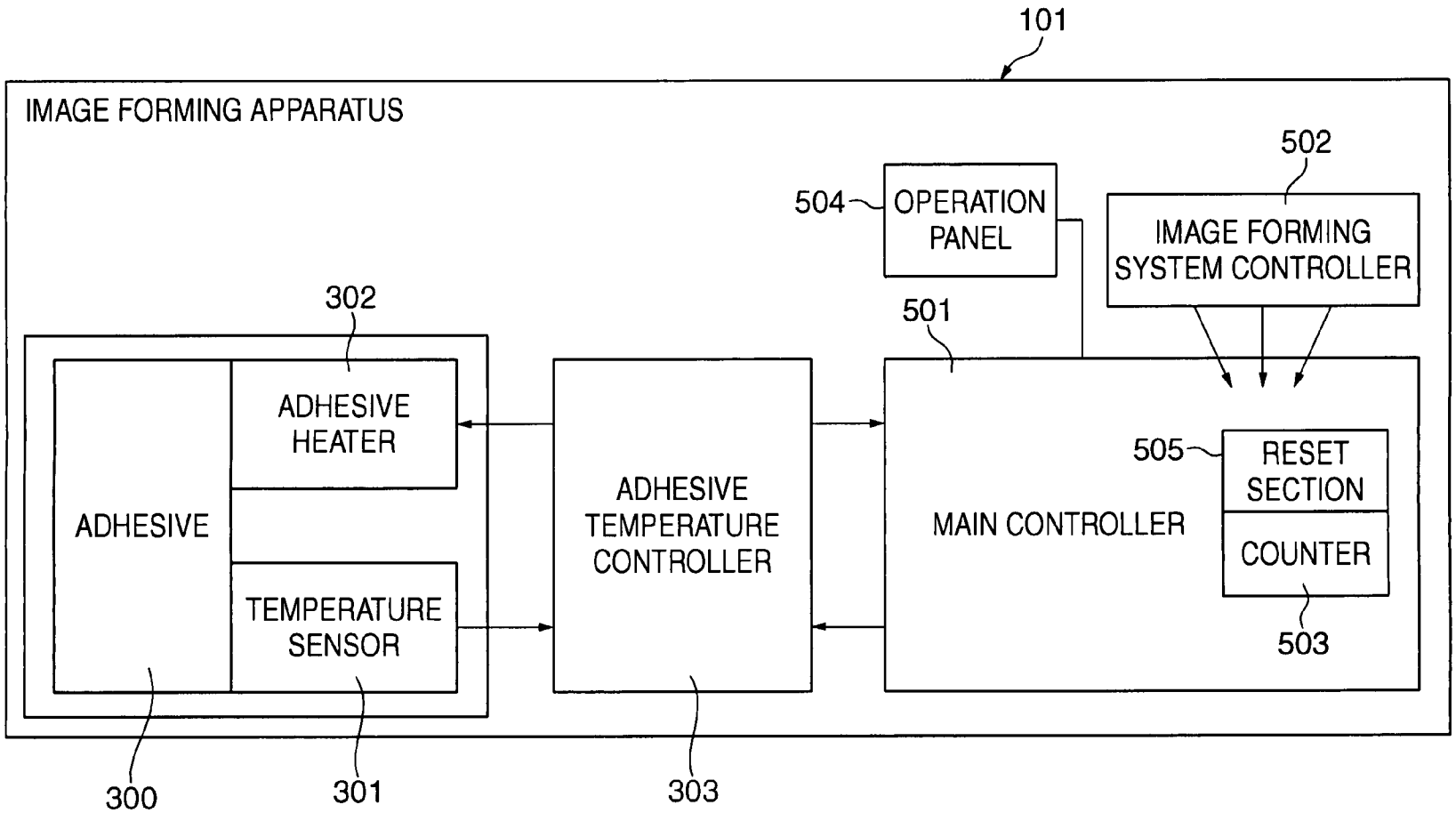
FIG. 14 is a schematic diagram useful in explaining a method of instructing temperature control of the adhesive of the image forming apparatus.

Thus, according to the second embodiment, it is possible to provide the same advantageous effects as provided by the first embodiment. Further, in the first and second embodiments, the bookbinding apparatus 100 and image forming apparatus 101 are formed in separate bodies. However, as shown in FIG. 14, the image forming apparatus 101 may have a bookbinding function including all the component elements of the bookbinding apparatus 100, to provide the same advantageous effects as provided by the first and second embodiments. In this case, the counter 503 needs only to be included in either the main controller 501 or the adhesive temperature controller 303.

While the embodiments of the present invention have been described above, it is to be understood that there is no intention to limit the invention to the above-described embodiments, but certain changes and modifications may be possible within the scope of the appended claims insofar as functions recited in the appended claims or the functions of the above-described embodiments can be achieved.

Further, it is to be understood that the object of the present invention may also be accomplished by supplying a system or an apparatus with a storage medium in which a program code of software which realizes the functions of any of the above-described embodiments is stored, and causing a computer (or CPU or MPU) of the system or apparatus to read out and execute the program code stored in the storage medium.

In this case, the program code itself read from the storage medium realizes the functions of any of the above-described embodiments, and hence the program code and the storage medium in which the program code is stored constitute the present invention.

Examples of the storage medium for supplying the program code include a floppy (registered trademark) disk, a hard disk, a magnetic-optical disk, an optical disk such as a CD-ROM, a CD-R, CD-RW, DVD-ROM, DVD-RAM, DVD-RW, and DVD+RW, a magnetic tape, a nonvolatile memory card, and a ROM. Alternatively, the program may be downloaded via a network.

Further, it is to be understood that the functions of any of the above-described embodiments may be accomplished not only by executing a program code read out by a computer, but also by causing an OS (operating system) or the like which operates on the computer to perform a part or all of the actual operations based on instructions of the program code.

Further, it is to be understood that the functions of any of the above-described embodiments may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

CROSS REFERENCE TO THE RELATED APPLICATION

This application claims priority from Japanese Patent Application Nos. 2004-217141 filed Jul. 26, 2004, and 2005-214901 filed Jul. 25, 2005. which are hereby incorporated by reference herein.

What is claimed is:

1. A bookbinding apparatus that is connectable to an image forming apparatus and carries out bookbinding by bonding a plurality of sheets outputted from the image forming apparatus using an adhesive, the bookbinding apparatus comprising:

a filter that prevents volatile components of the adhesive from leaking out to the surroundings;

a heating device that heats the adhesive;

a detecting device that detects a temperature of the adhesive;

an adhesive temperature controller that controls a heating temperature of the adhesive by said heating device, based on the temperature of the adhesive detected by said detecting device and a target temperature; and a filter exchange time determining device that determines whether or not said filter has reached an exchange time thereof, wherein said adhesive temperature controller is operable when said filter exchange time determining device determines that said filter has reached the exchange time thereof, to control the heating temperature of the adhesive by said heating device so that the temperature of the adhesive becomes lower than a predetermined temperature that is lower than the target temperature.

2. A bookbinding apparatus as claimed in claim 1, wherein said filter exchange time determining device comprises a counter that counts a number of times or a number of hours the bookbinding apparatus has been used, and determines that said filter has reached the exchange time thereof when the number of times or the number of hours counted by said counter exceeds a predetermined value.

3. A bookbinding apparatus as claimed in claim 1, further comprising:

a notifying device that is operable when said detecting device detects that the temperature of the adhesive has become lower than the predetermined temperature, to notify the image forming apparatus that the temperature of the adhesive has become lower than the predetermined temperature.

4. A bookbinding apparatus as claimed in claim 1, wherein the predetermined temperature is set at a value which can prevent volatilization of volatile components of the adhesive.

5. An image forming apparatus having a bonding-type bookbinding function of carrying out bookbinding by bonding a plurality of sheets with an adhesive, the image forming apparatus comprising:

a filter that prevents volatile components of the adhesive from leaking out to surroundings;

a heating device that heats the adhesive;

a detecting device that detects a temperature of the adhesive;

an adhesive temperature controller that controls a heating temperature of the adhesive by said heating device, based on the temperature of the adhesive detected by said detecting device and a target temperature; and a filter exchange time determining device that determines whether or not said filter has reached an exchange time thereof, wherein said adhesive temperature controller is operable when said filter exchange time determining device determines that said filter has reached the exchange time thereof, to control the heating temperature of the adhesive by said heating device so that the temperature of the adhesive becomes lower than a predetermined temperature that is lower than the target temperature.

6. An image forming apparatus as claimed in claim 5, further comprising:

a displaying device that displays a message to instruct an exchange of said filter.

7. An image forming apparatus as claimed in claim 5, further comprising:

a bonding-type bookbinding function inhibiting device that inhibits execution of the bonding-type bookbinding function.

8. An image forming apparatus as claimed in claim 5, wherein said filter exchange time determining device comprises a counter that counts a number of times or a number of hours the bonding-type bookbinding function has been used, and a reset device that resets said counter.

9. An image forming apparatus as claimed in claim 5, further comprising:

a transmitting device that is operable when said filter exchange time determining device determines that said filter has reached the exchange time thereof, to transmit an instruction to set the temperature of the adhesive to the predetermined temperature that is lower than the target temperature, to said adhesive temperature controller, wherein said adhesive temperature controller is operable when said transmitting device transmits the instruction to set the temperature of the adhesive to the predetermined temperature that is lower than the target temperature, to said adhesive temperature controller, to control the heating temperature of the adhesive by said heating device based on the instruction so that the temperature of the adhesive becomes lower than the predetermined temperature that is lower than the target temperature.

* * * * *